United States Patent [19]

Rennie

[11] Patent Number: 4,790,480

[45] Date of Patent: Dec. 13, 1988

[54] LIQUID FUEL ATOMISER

[75] Inventor: Alan G. Rennie, Derby, England

[73] Assignee: Northern Engineering Industries plc, Newcastle upon Tyne, England

[21] Appl. No.: 6,681

[22] Filed: Jan. 23, 1987

[30] Foreign Application Priority Data

Feb. 15, 1986 [GB] United Kingdom ..... 8603759

[51] Int. Cl.[4] ..... B05B 12/00; B05B 1/26

[52] U.S. Cl. ..... 239/125; 239/467; 239/498

[58] Field of Search ..... 239/498, 500, 501, 520, 239/125, 126, 73, 499, 518, 467, 418, 490

[56] References Cited

U.S. PATENT DOCUMENTS

| | | | |
|---|---|---|---|
| 3,275,248 | 9/1966 | O'Brien et al. | 239/498 |
| 3,920,187 | 11/1975 | Willis | 239/498 |
| 3,993,247 | 11/1976 | Tyler | 239/126 |
| 4,011,996 | 3/1977 | Tsuji et al. . | |
| 4,087,050 | 5/1978 | Tsuji et al. | 239/490 |
| 4,252,276 | 2/1981 | Aprea et al. | 239/499 |

FOREIGN PATENT DOCUMENTS 1453853 10/1976 United Kingdom .

OTHER PUBLICATIONS

"Control Technique for Nitric Oxide-Development of New Combustion Methods" by Tsuji et al, IHI Engineering Review, vol. 6, No. 2, Sep. 1973.

*Primary Examiner*—Andres Kashnikow
*Assistant Examiner*—Chris Trainor
*Attorney, Agent, or Firm*—Rosen, Dainow & Jacobs

[57] ABSTRACT

NOx production from pressure-atomised burners is reducible by shaping, e.g. splitting, the fuel film leaving the burner. This is achieved, in accordance with the invention, by having an external wall 54 which surrounds the fuel outlet orifice 52 and from which external formations 56 extend radially inwardly towards the axis 20 of the burner. The formations 56 penetrate the frusto-conical pattern of fuel (not shown) emitting from the orifice 52 to split the flame into four discrete lobes. Other arrangements are possible in which different numbers of lobes are formed; or assymetric patterns are produced; or shaped flame patterns having no discrete lobes are produced.

18 Claims, 4 Drawing Sheets

LIQUID FUEL ATOMISER

BACKGROUND TO THE INVENTION

The invention relates to liquid fuel atomisers.

Nitrogen oxides (NOx) emitted from boiler and furnace plants, for example, have been accused of causing serious pollution problems. The creation of NOx in liquid fuel burners is affected by a number of factors. For example, the relatively high residence times and temperatures experienced by the fuel and combustion air make significant contributions to NOx production from pressure-atomised burners which produce a relatively large high temperature flame.

It has been proposed (see, for example UK Patent No. 1453853, U.S. Pat. Nos. 4,011,996 and 4,087,050 and an article entitled "Control Technique for Nitric Oxide-Development of New Combustion Methods" by Tsuji S., Tsukada M. and Asai M., IHI Engineering Review, Vol. 6. No. 2, September 1973 published by Ishikawajima-Harima Jukogyo Kabushiki Kaisha) to reduce NOx production in such burners by producing a split flame pattern.

During development by the Applicant of an atomiser to generate a split flame pattern, an atomiser design was produced where the oil film was generated around substantially the whole circumference of the atomiser outlet but did not yield a true split flame pattern and the optimisation of the advantages thereof was not achieved. That atomiser was of a similar type to that shown in UK Patent No. 1453853.

The Applicants found also that, using an atomiser in which the split flame effect is achieved by mounting a plurality of rods on the cap nut around the periphery of the outlet from the orifice plate as is described in the above-mentioned article, some oil tends to flow around the backs of the rods and is sprayed back on to the cap nut. Clearly, such spurious oil flows, particularly on the cap nut, will lead to a build up of carbonised deposits on the atomiser to the detriment of the operation of the atomiser.

SUMMARY OF THE INVENTION

It is an object of the present invention to provide a liquid fuel atomiser in which the aforementioned disadvantages are reduced or obviated.

According to the present invention, a liquid fuel atomiser comprises a body within which are defined a fuel supply passage, a swirl chamber and annularly-distributed internal passages for fuel to flow from said supply passage to said swirl chamber to rotate therein about an axis of rotation passing through said chamber, an orifice defined by said body coaxial with said axis and through which fuel laves said chamber in a substantially hollow diverging frusto-conical pattern, an external wall formed on said body coaxially with said axis and surrounding said orifice and external formations extending radially inwardly from said wall at spaced-apart positions about said orifice and extending in directions parallel to said axis thereby to interact with fuel leaving said orifice to alter the shape of said frusto-conical pattern.

Preferably, a fuel return passage is defined within said body, said fuel return passage being in communication with said swirl chamber whereby fuel circulates through said body.

Preferably, a lance is mounted within said body coaxially with said axis for movement therealong between a first postion in which the tip of said lance closes said orifice and a second position in which the tip of said lance is withdrawn from said orifice.

Preferably, said orifice is bounded by a plain cylindrical surface.

Preferably, said external formations change said frusto-conical pattern into a pattern having discrete lobes, i.e. a fully split flame.

Preferably, the cross-section of each said external formation in a plane normal to said axis tapers in a direction substantially towards said axis.

Preferably, said external formations are located at positions concentric with said axis.

Preferably, said external formations have respective radially innermost extents lying on a common circle coaxial with said axis.

Preferably, said external formations are located no closer to said axis than a circle having a radius (R) equal to 1.25 times the radius of said orifice and said external formations have a minimum height (H) greater than $0.45\ R \tan(90-\alpha/2)$ where $\alpha$ is the included cone angle of said frusto-conical pattern.

BRIEF DESCRIPTION OF THE DRAWINGS

Liquid fuel atomisers will now be described to illustrate the invention by way of example only with reference to the accompanying drawings, in which.

DESCRIPTION OF THE PREFERRED EMBODIMENTS

Figure 1:
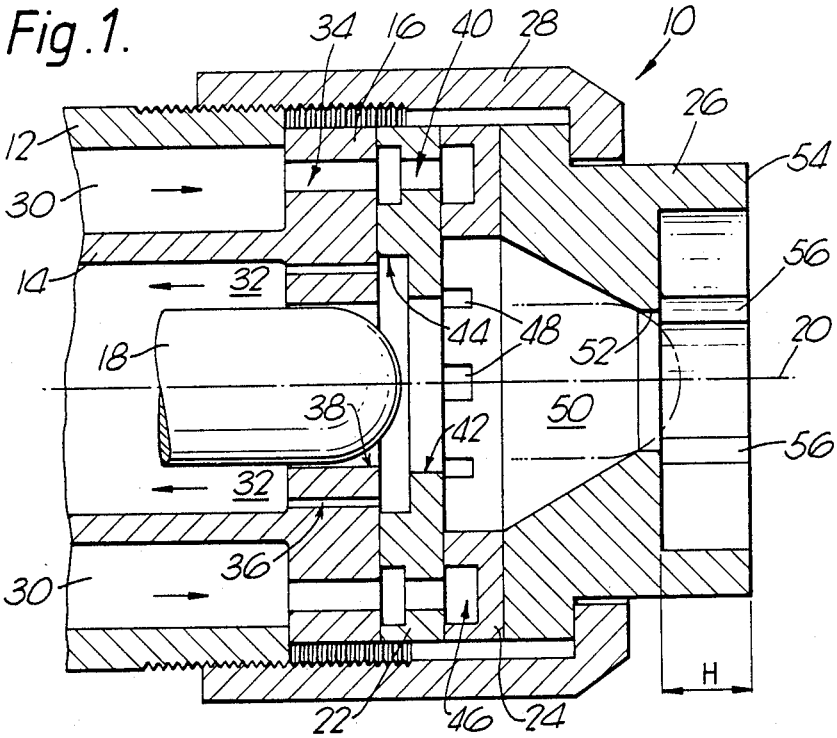
FIG. 1 is a longitudinal section in line I—I in FIG. 2 through a first embodiment of a liquid fuel atomiser constructed in accordance with the invention.
Figure 2:
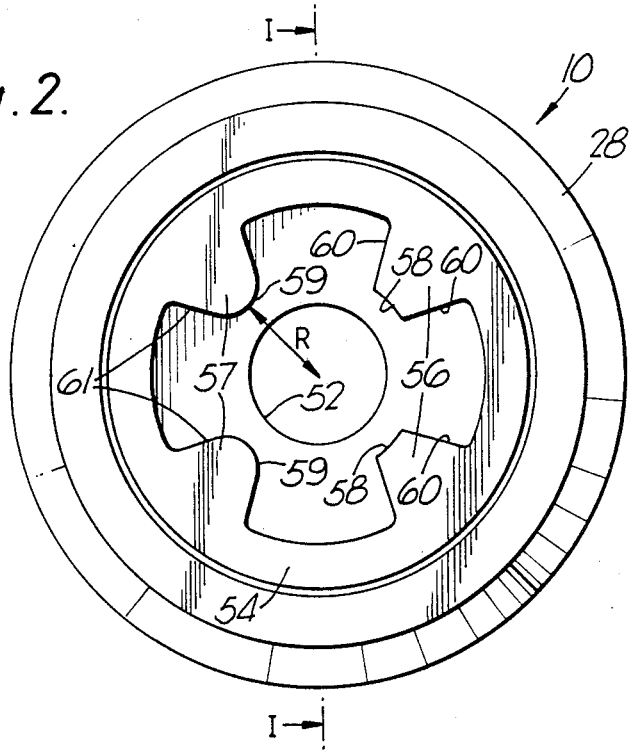
FIG. 2 is an end view of the atomiser shown in FIG. 1, the left-hand side of FIG. 2 showing a modified version of the atomiser.

Referrring to FIGS. 1 and 2, the liquid fuel atomiser 10 is of the pressure-atomising, spill-return, tip shut-off type.

The atomiser 10 has a body consisting of an outer tube 12; an inner tube 14 which terminates in an annular flange 16 and within which is mounted a lance 18, the flange 16 being in engagement with one end of the tube 12; an annular back plate 22 located on the flange 16; an annular swirl plate 24 located on the back plate 22; an annular orifice plate 26 located on the swirl plate 24; and an annular cap nut 28 which is screwed onto the threaded end of the outer tube 12 and which engages an annular shoulder on the orifice plate 26 thereby to hold the various components in their respective positions.

The outer tube 12 together with the inner tube 14 define an annular fuel supply passage 30. The inner tube 14 together with the lance 18 define an annular fuel return or spill passage 32. The flange 16 of the inner tube has first and second sets of circumferentially-disposed ports 34, 36. The ports 34 are outlet ports for the passage 30 and the ports 36 are inlet ports for the passage 32. The lance 18 is mounted for movement along the longitudinal axis 20 of the atomiser 10 and is a close fit within and substantially closes the central bore 38 through the flange 16.

The back plate 22 has circumferentially-disposed ports 40 which register with the ports 34 and a central bore 42 which has a diameter greater than the diameter of the lance 18 whereby the lance can pass therethrough. The bore 42 is countersunk at 44 such that the ports 36 communicate with the bore 42.

The swirl plate 24 has an annular gallery 46 which registers with the ports 40 in the back plate 22. Annularly-distributed internal passages 48 in the swirl plate 24 lead from the gallery 46 into a swirl chamber 50 defined by the swirl plate 24 and the orifice plate 26. The passages 48 are disposed at an angle, typically tangentially, to the axis 20 whereby fuel flowing into the chamber 50 rotates about the axis 20 which becomes, for the rotating fluid, an axis of rotation.

Owing to the bore of the orifice plate 26 being frusto-conical in longitudinal section along part of its length, the swirl chamber 50 tapers in a direction along the axis 20 leading to an orifice 52 which is bounded by a plain cylindrical surface. Fuel leaves the orifice 52 in a substantially hollow diverging frusto-conical pattern.

Figure 6:
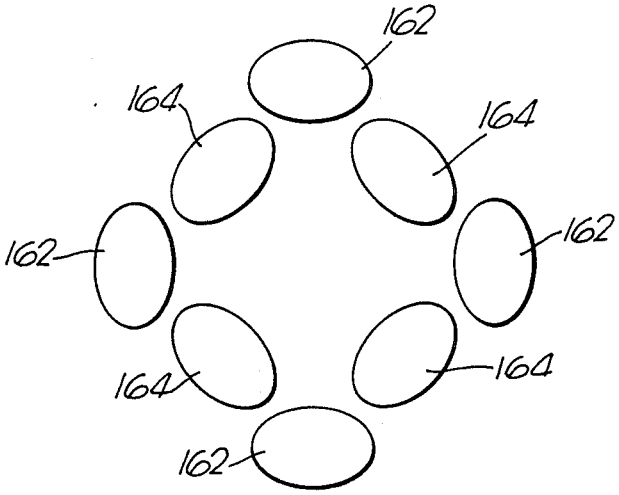
FIG. 6 is an end view of the spray pattern produced by the atomiser shown in FIGS. 4 and 5.

The orifice plate 26 has an annular wall 54 coaxial with the axis 20. External formations 56, which are integral with the wall 54, extend radially inward towards the axis 20. The formations 56 have respective radially inner surfaces 58 (see right hand half of FIG. 2) which lie on a common circle which has a radius R (see below) and which is coaxial with the axis 20. The circumferential extent of each radially inner surface 58 is relatively small to ensure the frusto-conical pattern formed by the orifice 52 is positively split and not deflected (see description below both in respect of this embodiment and the embodiment described with reference to FIGS. 4 and 6). The cross-sections of the external formation 56, in a plane normal to the axis 20, taper in a direction towards the axis 20, the sides 60 of the formations 56 being bounded by plane surfaces which meet the radially inner surfaces 58 at sharp corners.

Based on results, the minimum radially inner position and height of the external formations are selected using the empirical formulae:

$$R \geqq 1.25 \text{ times the radius of the orifice} \quad (1)$$

$$H > 0.45\ R \tan(90-\alpha/2) \quad (2)$$

R, H and $\alpha$ being as defined above.

Figure 3:
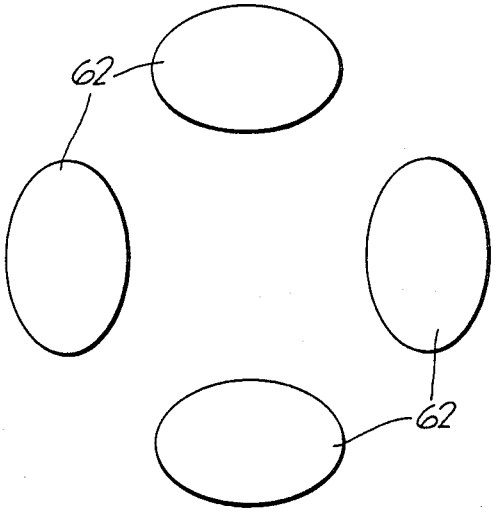
FIG. 3 is an end view of the spray pattern produced by the atomiser shown in FIGS. 1 and 2.

In this embodiment, the height H is selected to extend wholly through the fuel film whereby the frusto-conical pattern formed by the orifice 52 is split into four discrete lobes 62 (see FIG. 3). The radius R was 1.4 times the orifice radius.

The lance 18 has a diameter such that, when it has been moved along the axis 20 to the position shown in dotted outline in FIG. 1, the tip of the lance 18 closes the orifice 52. The external formations 56 do not affect the swirl chamber surface on which the lance 18 seals.

In operation, when the lance 18 has closed the orifice 52, liquid fuel is circulated under high pressure through the atomiser 10 in the reverse direction to that described in the next paragraph.

Immediately prior to atomisation, a valve (not shown) is operated to reverse the circulating flow, the flow path through the atomiser 10 then being along the supply passage 30; through the ports 34 and 40 into the gallery 46; through the passages 48 into the swirl chamber 50; through the bore 42; through the ports 36; and through the spill passage 32.

The reversed flow of fuel causes the lance to move along the axis 20 to open the orifice 52. A proportion of the fuel circulating through the atomiser 10 now flows through the orifice 52. The fuel is accelerated, owing to the decrease in cross-section of the swirl chamber 50, as it moves spirally to the orifice 52. The fuel leaves the orifice 52 in a hollow diverging frusto-conical pattern which interacts with the external formations 56 to be split into four discrete lobes 62 (see FIG. 3).

In a modification, the external formations 57 (see left hand half of FIG. 2) have radially inner surfaces 59 which are part-circular and have a curvature opposite to the curvature of the common circle on which the radially innermost extents of the external formations 56 lie. The sides 61 of the external formations 57 are tangential to the surfaces 59. Preferably, the radius of curvature of the surfaces 59 is 0.2 times the diameter of the orifice 52.

Figure 4:
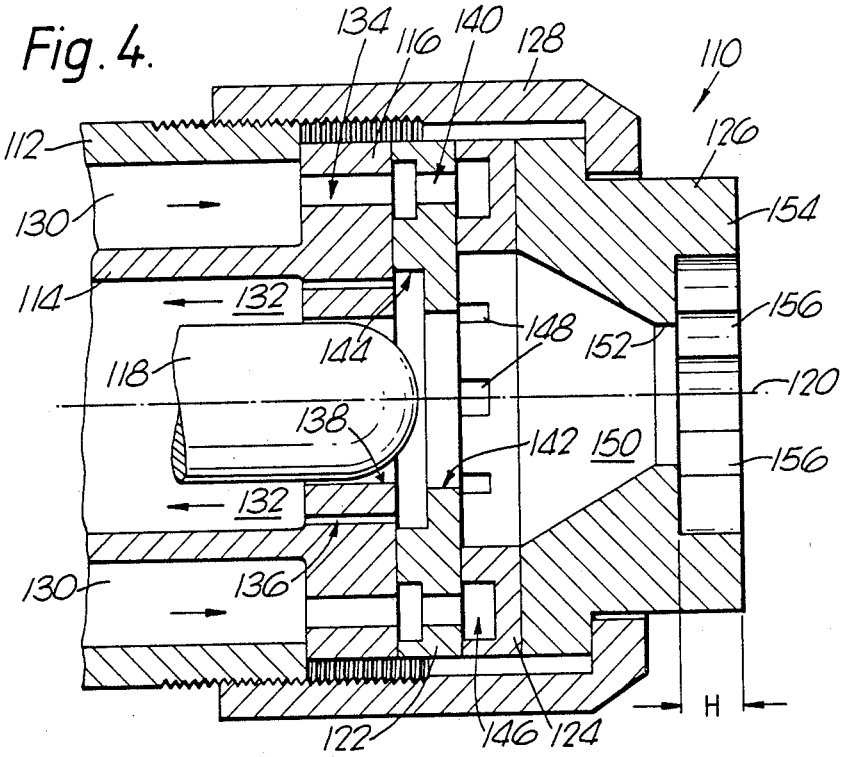
FIG. 4 is a longitudinal section on line IV—IV in FIG. 5 through a second embodiment of a liquid fuel atomiser constructed in accordance with the invention.
Figure 5:
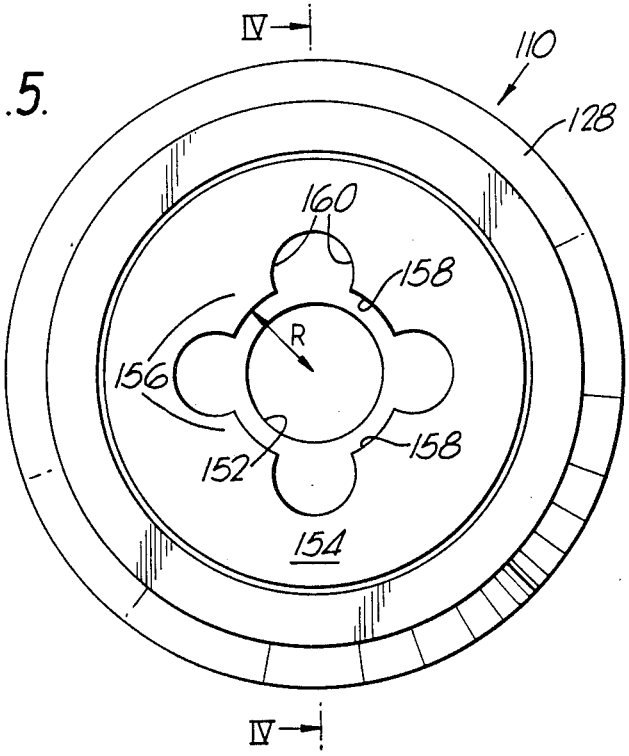
FIG. 5 is an end view of the atomiser shown in FIG. 4.

Referring now to FIGS. 4 and 5, the atomiser 110 shown therein has substantially the same basic construction as the atomiser 10. Consequently, the reference numerals used in FIGS. 1 and 2 have been used in FIGS. 4 and 5 for like parts but with the prefix "1".

In the atomiser 110, the external formations 156 are modified as compared to the external formations 56 of the atomiser 10.

The external formations 156 have sides 160 which are concave when viewed in a direction parallel to the axis 120. Furthermore, the circumferential extent of each radially inner surface 158 is relatively large whereby the radially inner surfaces 158 deflect parts of the fuel film to effect a split in the fuel film rather than protruding through the fuel film to effect a split in the manner of the surfaces 58 of the atomiser 10. As a consequence, the frusto-conical pattern is split into four discrete lobes 162 (see FIG. 6), corresponding to the lobes shown in FIG. 3, and into four discrete lobes 164 (see FIG. 6) which are formed by the deflected portions of the fuel film and which have centres closer to the axis 120 than the centres of the lobes 162.

Referring now to FIG. 7, again reference numerals used in FIGS. 1 an 2 have been used in FIG. 7 for like parts but with the prefix "2".

Figure 7:
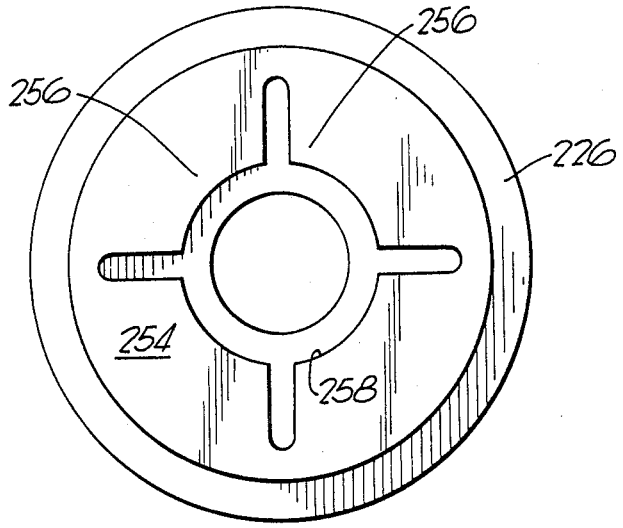
FIG. 7 is an end view of the orifice plate of a third embodiment of a liquid fuel atomiser constructed in accordance with the invention.

In FIG. 7, the external formations 256 are similar to the external formations 56 shown in the right hand half of FIG. 2 except that the circumferential extent of each radially inner surface 258 of the external formations 256 is considerably greater than the circumferential extent of the corresponding surfaces 58 of the external formations 56 whereby adjacent external formations 256 are separated from one another by parallel-sided slots.

In use, the orifice plate 226 is used in a burner body similar to that shown in the other figures and it produces a flame pattern similar to the orifice plate 126 but with a greater angular difference between the inner lobes and the outer lobes and with a greater proportion of the fuel being contained in the inner lobes as compared to the outer lobes.

As discussed previously, in the prior proposed atomiser in which rods are located about the periphery of the outlet, fuel is induced to flow around the curved surfaces of the rods. In atomisers constructed in accordance with the present invention, the combination of the wall 54, 154, 254 and the external formations 56, 156, 256 avoids that problem whilst achieving split flames and low NOx levels, e.g. 200 to 240 ppm.

Modifications are possible within the scope of the invention. For example, the external formations can be located such as to produce assymetric flame patterns; or different numbers of lobes; or, if desired the geometry of the exit formations can be altered to produce shaped flame patterns which do not have discrete lobes.

The basic constructions of a pressure-atomising, spill-return, tip shut-off atomiser is well known per se and can take various forms. The construction described with reference to the drawings is intended to be exemplary and not limiting.

I claim:

1. A liquid fuel atomiser comprising a body within which are defined a fuel supply passage, a swirl chamber and annularly-distributed internal passages for fuel to flow from said supply passage to said swirl chamber to rotate therein about an axis of rotation passing through said chamber, an orifice defined by said body coaxially with said axis, said orifice having an inlet opening communicating with said chamber and an outlet opening from which fuel exits from said orifice in a substantially hollow diverging frusto-conical pattern, an external wall having an inner diameter greater than said outlet opening being formed on said body coaxially with said axis immediately downstream, relative to fuel flow, of said orifice and external formation extending both parallel to said axis and radially inwardly from said wall at circumferentially spaced-apart positions about said wall, said external wall being continuous both in a direction parallel to said axis and in a circumferential direction, and each of said radially inwardly extending formations terminating in an inward edge, the radial distance between generally opposite inward edges thereof being greater than the diameter of the outlet opening of said orifice, thereby to interact with the fuel exiting from said orifice to alter the shape of said frusto-conical pattern into a split pattern.

2. An atomiser according to claim 1, which a fuel return passage is defined within said body, said fuel return passage being in communication with said swirl chamber whereby fuel circulates through said body.

3. An atomiser according to claim 1 in which a lance is mounted within said body coaxially with said axis for movement therealong between a first position in which the tip of said lance closes said orifice and a second position in which the tip of said lance is withdrawn from said orifice.

4. An atomiser according to claim 1, in which said orifice is bounded by a plain cylindrical surface opposite ends of which define respectively said inlet opening and said outlet opening.

5. An atomiser according to claim 1, in which said external formations change said frusto-conical pattern into a pattern having discrete lobes.

6. An atomiser according to claim 1, in which the cross-section of each said external formation in a plane normal to said axis tapers in a direction substantially towards said axis.

7. An atomiser according to claim 1, in which said external formations are located at positions concentric with said axis.

8. An atomiser according to claim 1, in which the sides of said external formations are bounded by plane surfaces.

9. An atomiser according to claim 1, in which the sides of said external formations are bounded by surfaces which are concave when viewed in a direction parallel to said axis.

10. An atomiser according to claim 1, in which the junctions of said surfaces of said external formations with one another or with radially inner surfaces comprise sharp corners.

11. An atomiser according to claim 1, in which said external formations each have a respective radially inner surface lying on a circle coaxial with said axis.

12. An atomiser according to claim 11, in which the circumferential extent of each said radially inner surface is relatively small whereby the shape of said frusto-conical pattern is changed by radial splitting of said pattern.

13. An atomiser according to claim 11, in which the circumferential extent of each said radially inner surface is relatively large whereby the shape of said frusto-conical pattern is changed by deflecting portions of the fuel film.

14. An atomiser according to claim 1, in which said external formations each have a respective radially inner surface which is part-circular and has a curvature opposite to the curvature of a circle concentric with said axis.

15. An atomiser according to claim 14, in which the sides of the external formations are bounded by surfaces tangential to said part-circular radially inner surface.

16. An atomiser according to claim 1, in which said external formations have radially innermost extents lying on a common circle concentric with said axis.

17. An atomiser according to claim 1, in which the radially innermost extents of said external formations are located no closer to said axis than a circle having a radius (R) equal to 1.25 times the radius of said orifice and said external formations have a minimum height (H) greater than 0.45 R tan $(90-\alpha/2)$ where $\alpha$ is the included cone angle of said frusto-conical pattern.

18. A liquid fuel atomiser comprising a body within which are defined a fuel supply passages, a swirl chamber and annularly-distributed internal passages for fuel to flow from said supply passage to said swirl chamber to rotate therein about an axis of rotation passing through said chamber, an orifice defined by said body coaxially with said axis, said orifice having an inlet opening communicating with said chamber and an outlet opening from which fuel exits from said orifice in a substantially hollow diverging frustoconical pattern, an external wall having an inner diameter greater than said outlet opening being formed on said body coaxially with said axis immediately downstream, relative to fuel flow, of said orifice and external formations extending both parallel to said axis and radially inwardly from aids wall at circumferentially spaced-apart positions about said wall, said external wall being continuous both in a direction parallel to said axis and in a circumferential direction, and each of said radially inwardly extending formations terminating in an inward edge, all said inward edges together defining a circle which is coaxial with and has a diameter greater than the outlet opening of said orifice, thereby to interact with the fuel exiting from said orifice to alter the shape of said frusto-conical pattern into a split pattern.

* * * * *

UNITED STATES PATENT AND TRADEMARK OFFICE

CERTIFICATE OF CORRECTION

PATENT NO. : 4,790,480

DATED : December 13, 1988

INVENTOR(S) : Alan G. Rennie

It is certified that error appears in the above-identified patent and that said Letters Patent is hereby corrected as shown below:

Column 1, line 54, change "laves" to --leaves--.

Column 5, line 43, before "which" insert --in--.

Column 6, line 56, change "aids" to --said--.

Signed and Sealed this

Fourth Day of July, 1989

*Attest:*

*Attesting Officer*

DONALD J. QUIGG

*Commissioner of Patents and Trademarks*